United States Patent [19]

Jackson

[11] 4,305,559

[45] Dec. 15, 1981

[54] SUPPORT FOR CURVED SURFACES

[75] Inventor: Wendell T. Jackson, Walnut Creek, Calif.

[73] Assignee: Hexcel Corporation, San Francisco, Calif.

[21] Appl. No.: 84,953

[22] Filed: Oct. 15, 1979

[51] Int. Cl.[3] ..... A47G 23/02

[52] U.S. Cl. ..... 248/146; 126/215; 432/232

[58] Field of Search ..... 248/146, 152, 154, 311-312; 126/262, 215, 65; 428/116, 118; 432/232

[56] References Cited

U.S. PATENT DOCUMENTS

| | | | |
|---|---|---|---|
| 1,069,783 | 8/1913 | Hodges | 126/215 UX |
| 1,412,208 | 4/1922 | Johnson | 126/215 |
| 2,280,061 | 4/1942 | Cartter et al. | 126/215 UX |
| 2,720,948 | 10/1955 | Pajak | 428/116 X |
| 3,526,072 | 9/1970 | Campbell | 428/116 X |
| 4,198,839 | 4/1980 | Linko et al. | 428/116 X |

FOREIGN PATENT DOCUMENTS

| | | | |
|---|---|---|---|
| 628047 | 3/1936 | Fed. Rep. of Germany | 126/215 |

*Primary Examiner*—J. Franklin Foss

*Attorney, Agent, or Firm*—Townsend and Townsend

[57] ABSTRACT

The present invention is a round-bottom flask support which comprises a base of honeycomb or honeycomb-like material flat on its lower surface and having a concave upper surface substantially complementary to the flask it is designed to support. The cross section of the base is preferably cylindrical and a cylindrical annular ring engaging the periphery of the base and upper surface can be provided for added dimension stability.

The upper surface of the base preferably has a semi-spherical configuration produced by compression of the upper surface of the base toward the lower surface to create "pleats" in at least some cell walls. This provides an added mechanical lock at the cell nodes which reduces the tendency of the honeycomb to separate at the cell nodes and is of particular advantage where the honeycomb is subjected to high temperatures and the adhesive bond may be weakened. The honeycomb base is usually aligned so that the cells extend transversely to the lower surface of the base and at least some cells usually communicate between the lower surface and the upper surface of the base.

The material from which the honeycomb can be constructed is highly variable but is preferably largely unaffected by moisture or temperature changes. More preferably, this material is stable upon the application of heat from a hot plate and is non-ferromagnetic.

1 Claim, 6 Drawing Figures

SUPPORT FOR CURVED SURFACES

BACKGROUND OF THE INVENTION

1. Field of the Invention

This invention relates to supports and supportive adapters for curved surfaces, particularly adapters used to support a round-bottom flask on a standard hot plate to heat the contents of the flask. The invention also relates to such adapters utilizing improved honeycomb material with improved mechanical stability at the cell nodes.

2. Summary of the Prior Art

In the course of chemical laboratory work, it is constantly necessary to store, heat and/or cool solutions in various flasks. Most organic reactions, in fact, are carried out in the laboratory in round-bottom (spherical) flasks made of Pyrex glass, these flasks having the optimum shape for strength under vacuum. The flask shape being spherical, it is necessary to provide supporting apparatus to maintain the flask upright.

For ordinary storage of such flasks, cork or rubber rings are normally used. However, due to the low thermal conductivity of such rings as well as their deterioration upon the application of high temperatures, they can not be effectively used to support a flask on a hot plate to heat the contents of the flask. Consequently, where the flask contents are to be heated, alternate flask supports have been used.

One such support is a hot oil bath resting on a standard hot plate, and used in conjunction with clamps attached to an upright stand to support the flask in the bath. Such a liquid bath may incur contamination and may be subject to spillage and possible ignition. On the other hand, hot sand baths are nonflammable but may be untidy. While molten metal alloy baths afford uniform support, they are very expensive and require clamps to secure the flask and counteract bouyancy. Porcelain heaters containing bare glowing resistance wires afford rapid heating but at risk of vessel breakage and possible fire hazard of spilled liquid. Safer and more convenient are heating mantles especially adapted for round bottomed flasks which incorporate resistance elements within glass fabric contoured surfaces; however, these units usually must be separately provided by a laboratory in addition to standard flat surface hot plates required for other uses.

SUMMARY OF THE INVENTION

The present invention is a support for curved surfaces such as round-bottom flasks which avoids many difficulties associated with supports previously used. In one aspect of the invention, the support comprises a base of honeycomb or honeycomb-like material which is flat on its lower surface and which has a concave upper surface substantially complementary to the curved surface it is designed to support. The honeycomb or honeycomb-like material is a structural material having relatively large cells therein. Actual honeycomb itself consists of a series of thin webs of appropriate material bent, aligned and attached to each other to define six-sided cells. In the remainder of this specification and the claims, the term "honeycomb" will be used to denote actual honeycomb as well as honeycomb-like material, and the term "actual honeycomb" to denote honeycomb having six-sided cells.

The honeycomb base is preferably aligned so that the cells extend approximately vertically from the lower surface to the upper surface of the base and the perimeter of the base is preferably cylindrical to be most cost effective. A cylindrical annular rim is usually included to finish the edges and provide added support. The material from which the honeycomb can be constructed is highly variable but is preferably largely unaffected by moisture or temperature changes. A number of adhesives can be used to attach the webs forming the honeycomb together, the adhesive usually being a modified phenolic resin.

In the preferred embodiment of the invention, the concave upper surface of the base has a semi-spherical configuration adapted to support a spherical surface such as a round-bottom flask. Preferably, the upper surface is so contoured by compression of the upper surface of the base in the direction of the lower surface by an appropriately shaped mandrel. This provides a mechanical lock in addition to the adhesive bond at the cell nodes of the honeycomb and reduces the tendency of the honeycomb webs to separate at the cell nodes. It is of particular advantage where the honeycomb is subjected to high temperatures which might weaken the adhesive bond.

In a preferred embodiment of the above invention, the honeycomb base is constructed of a material which is stable upon the application of heat from a hot plate and has sufficient thermal conductivity to effectively heat the contents of the flask while it supports a flask on a hot plate. Additionally, the material is preferably non-ferromagnetic. Specifically, the preferred material is aluminum. Another preferred material is graphite and in some embodiments, the aluminum honeycomb is coated with graphite.

The above flask support provides numerous advantages over prior supports. The support is lightweight, inexpensive, simple to use, and is appropriate in many applications. At the same time the honeycomb base provides excellent structural strength and rapid heat transfer by radiation and convection through the air in the cells. In the case of aluminum honeycomb, heat transfer from a hot plate to the flask is facilitated due to the relatively high thermal conductivity of aluminum. Also, because aluminum and graphite are non-ferromagnetic and transparent to magnetic flux, a bar magnet can conveniently be used to stir the contents of the flask in conjunction with a built-in stirrer in the hot plate.

DETAILED DESCRIPTION OF THE PREFERRED EMBODIMENTS

Figure 1:
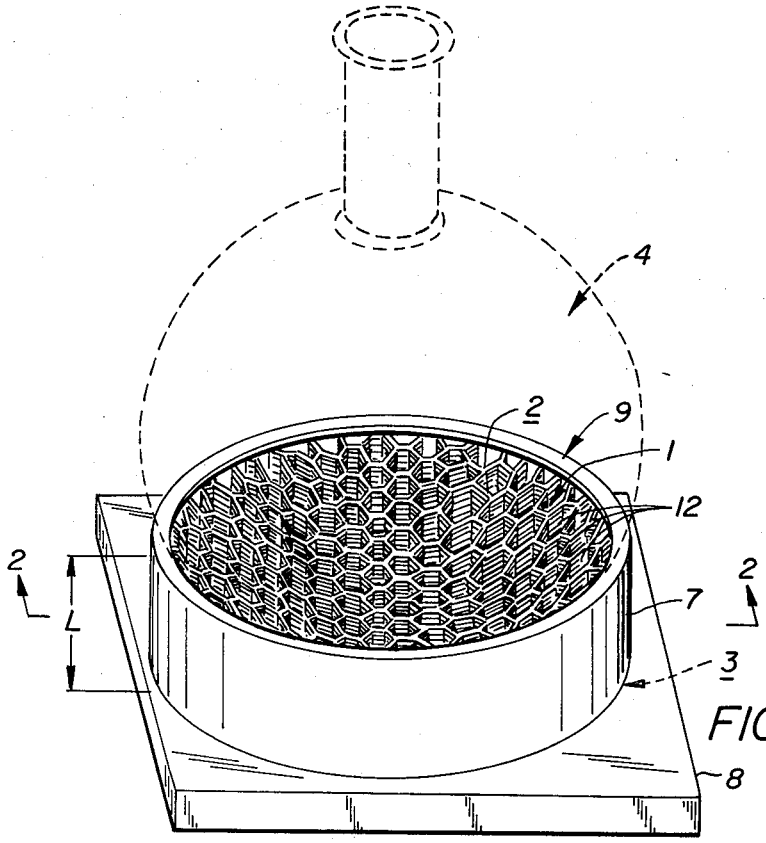
FIG. 1 is a perspective view of the preferred embodiment of the flask support of the present invention shown supporting a round-bottom flask.

Referring to FIG. 1, the support includes a honeycomb or honeycomb-like base 1 having a concave upper surface 2 and a lower surface 3. The lower surface 3 is preferably flat and the upper surface 2 has a concave configuration substantially complementary to the curved surface it is designed to support. In this case, the upper surface is semi-spherical to support round-bottom flask 4. The perimeter of the base is preferably cylindrical in shape to be most cost-effective.

Figure 3D:
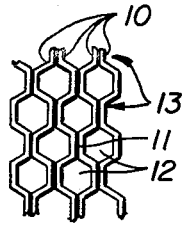
FIG. 3D is an enlarged plan view of actual honeycomb.
Figure 3A:
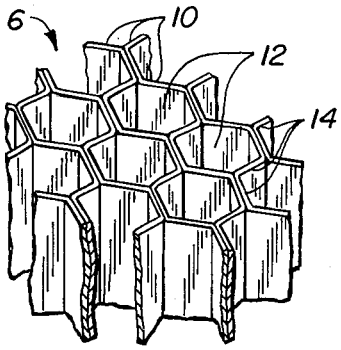
FIGS. 3A through 3C are large fragmentary perspective views of cross-sections of uncompressed and compressed actual honeycomb and honeycomb in the process of compression, respectively.

In the preferred embodiment, the base is composed of actual honeycomb which is illustrated in FIGS. 3A and 3D. Actual honeycomb is comprised of a series of relatively thin webs 10 bent and adhered together by an adhesive 11 (shown in FIG. 3D), preferably a modified phenolic resin to form a structural material having six-sided cells 12. However, it is contemplated that the honeycomb of the present invention includes as well any structural material containing relatively large cells, whatever shape they may have.

In the preferred embodiment of the invention illustrated in FIG. 1, the cells 12 extend vertically from the upper surface 2 to the lower surface 3. This promotes heat transfer through the support by convection and radiation through the cellular air space when the support is used together with a hot plate 8 to heat the flask 4 and its contents.

The honeycomb is preferably composed of a material relatively unaffected by moisture and capable of withstanding temperatures up to about 700° F. without deterioration. In addition, the preferred material will be a non-thermal insulator and will have a relatively high thermal conductivity to promote heat transfer through the support. The preferred materials are aluminum and graphite, and in one specific embodiment of the invention the material is aluminum coated with colloidal graphite. Other materials may be, for example, copper or stainless steel.

In addition, the material forming the honeycomb is preferably non-ferromagnetic so as not to shield from the flask a magnetic field created by coils in some hot plates. This magnetic field is used to produce continuous rotation of a bar magnet in the flask to stir the flask contents.

Heating time and rate of cooling for 250 mls tap water in a 500 ml round-bottom flask supported on a hot plate by identical size supports of the present invention made of aluminum and graphite-coated aluminum are shown in Table 1.

TABLE 1

| Base | Heating Time[1] in minutes (66° F. to 212° F.) | Cooling Rate[2] In Degrees F. 0 min. | 5 min | 15 min | 35 min | 75 min |
|---|---|---|---|---|---|---|
| Actual Honeycomb Support, Aluminum | 12.0 | 212 | 193 | 163 | 119 | 102 |
| Actual Honeycomb Support, Graphite-Coated Aluminum | 10.0 | 212 | 193 | 164 | 130 | 102 |

[1]Using Chromalox hot plate (660 Watts) already hot. Bar magnet not used.
[2]Cooled at ambient temperatures with flask supported on stone bench top by means of adapter of present invention.

Results of these tests show that the graphite coated aluminum honeycomb base provided better heat transfer to the flask than the aluminum honeycomb base.

Figure 3C:
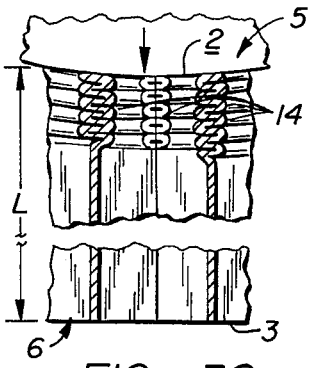
Figure 3B:
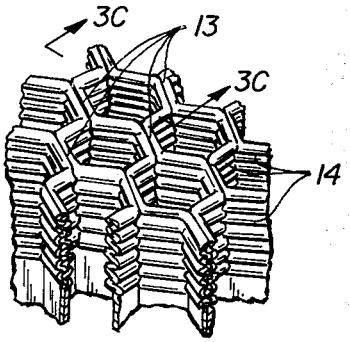

Referring to the drawings, in a preferred embodiment the upper surface 2 of the flask support is shaped to the desired configuration by compression of the upper surface 2 in the direction of the cell length L. An appropriately shaped mandrel 5 can be used for this purpose. The mandrel is preferably identical in shape to the lower portion of the flask. FIGS. 3A through 3C illustrate the manner in which the upper surface of the support is deformed by compression. FIG. 3A illustrates uncompressed actual honeycomb 6, FIG. 3B illustrates the honeycomb 6 undergoing compression in the direction of the cell length, L, by means of a mandrel 5. As shown in FIGS. 3C and 3B the resulting compressed honeycomb is in effect "pleated" at the cell walls 14. This pleating is of particular advantage in the support of the present invention because it provides a mechanical lock at the cell nodes 13 of the honeycomb and reduces the tendency of the honeycomb webs 10 to separate at the nodes 13, especially if the adhesive bond 11 is weakened due to excessive heating.

To increase the dimensional stability of the fresh formed expanded honeycomb support, to protect its sides against damage and/or deformation and to prevent fraying of the honeycomb webs, the support is preferably enclosed by an annular cylindrical ring 7 also formed of aluminum. Ring 7 includes an upper lip 9 which extends over and rings the periphery of the upper surface 2. The ring 7 is preferably first formed to a slightly smaller diameter than the base and then placed over and around the base, the forces due to the resulting compression of the perimeter of the base holding the ring 7 in place. Alternatively, an appropriate bonding agent can be used to secure the ring to the base.

Figure 2:
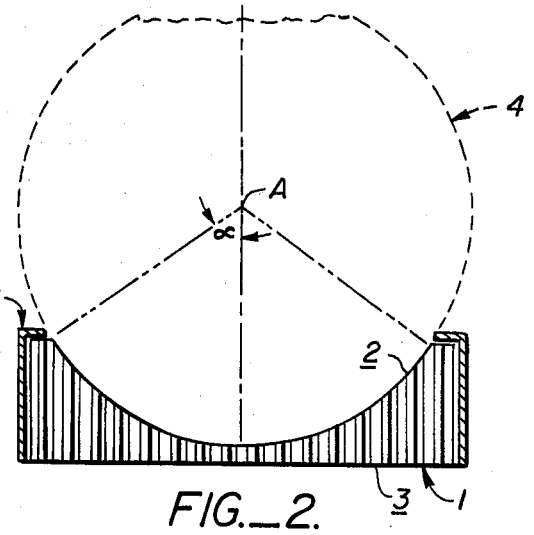
FIG. 2 is a schematic side elevation of the support of the present invention and is taken on line 2—2 of FIG. 1.

To promote the rapid heating of the contents of the flask the semi-spherical upper surface 2 (which is complementary to the bottom of the flask 4) has the following configuration in respect to the flask. The angle $\alpha$ shown in FIG. 2 is in the range set forth below. Angle $\alpha$ is one half the conical angle whose apex concides with the center A of the flask and spans the area of contact of the flask with the honeycomb. The thickness of the honeycomb is prescribed for any given angle $\alpha$ and flask diameter.

Table 2 illustrates the heat-up times obtained by heating approximately 250 mls of tap water in a standard 500 ml round-bottom flask (diameter 4.00 inches) from 68° F. to 212° F. using an aluminum support of the present invention with various angles $\alpha$. The tests were performed using an already hot Chromalox hot plate (without stirring), and where cooling rates were also obtained, the support and flask were transferred to a stone bench top for cooling at ambient temperatures. The total weight of each flask plus the tap water was 410.5 grams and all the supports tested were made of aluminum and did not contain the cylindrical annular rim 7.

TABLE 2

| $\alpha$ | | Heating Time (Minutes) | Cooling Rates (Degrees F.) 0 min. | 5 min. | 15 min. | 35 min. | 75 min. |
|---|---|---|---|---|---|---|---|
| 90° | Trial 1 | 12.0 | 212 | 200 | 172 | 138 | 107 |

TABLE 2-continued

| α | | Heating Time (Minutes) | Cooling Rates (Degrees F.) 0 min. | 5 min. | 15 min. | 35 min. | 75 min. |
|---|---|---|---|---|---|---|---|
| | Trial 2 | 11.75 | | Not performed | | | |
| | Trial 3 | 11.0 | 212 | 200 | 172 | 138 | 107 |
| 60° | | 12.5 | | Not Performed | | | |
| 55° | Trial 1 | 10.75 | 212 | 192 | 164 | 133 | 107 |
| | Trial 2 | 11.0 | | | | | |
| 50° | | 12.75 | | Not Performed | | | |
| 40° | | 13.0 | 212 | 190 | 163 | 132 | 100 |

From the results of this data, it can be seen that in order to minimize heating time, the support of the present invention will be constructed so that it has an angle α in the range between about 50° to about 60° and preferably in the vicinity of 55°. Although an angle α of 90° also results in a minimal heating time, this angle is not preferred because of the large quantity of honeycomb required.

It is to be understood that the above description and illustrations are not to be taken by way of limitation and that further aspects and modifications of the invention will be apparent to one skilled in the art.

What is claimed is:

1. A support for a round-bottom flask comprising:

a honeycomb base formed by cell walls defining honeycomb cells, the base having a concave upper surface with a semispherical configuration substantially complementary to a surface of the flask, a flat lower surface and a substantially cylindrical cross-section, the honeycomb cells extending transversely with respect to the lower surface, at least some of said cells providing fluid communication between the lower and upper surfaces, at least some of the honeycomb cell walls being mechanically interlocked at cell nodes where walls are secured to each other, to reduce the tendency of the honeycomb cell walls to separate at the nodes; and a cylindrical annular ring engaging the periphery of the base and having an upper lip extending over a peripheral portion of the upper surface of the base to promote dimensional stability of the support.

* * * * *